US008860532B2

(12) United States Patent
Gong et al.

(10) Patent No.: US 8,860,532 B2
(45) Date of Patent: Oct. 14, 2014

(54) INTEGRATED CAVITY FILTER/ANTENNA SYSTEM

(75) Inventors: Xun Gong, Oviedo, FL (US); Yazid Yusuf, Orlando, FL (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 586 days.

(21) Appl. No.: 13/112,389

(22) Filed: May 20, 2011

(65) Prior Publication Data

US 2012/0293279 A1 Nov. 22, 2012

(51) Int. Cl.

| | |
|---|---|
| ***H01P 1/208*** | (2006.01) |
| ***H01Q 9/04*** | (2006.01) |
| ***H01Q 9/32*** | (2006.01) |
| ***H01P 3/12*** | (2006.01) |

(52) U.S. Cl.

CPC ..... *H01P 1/2088* (2013.01); *H01P 1/2084* (2013.01); *H01Q 9/0407* (2013.01); *H01Q 9/32* (2013.01); *H01P 1/208* (2013.01); *H01P 3/121* (2013.01)

USPC ..... 333/202; 333/212; 333/227

(58) Field of Classification Search

USPC ..... 333/202, 209, 230, 212

See application file for complete search history.

(56) References Cited

U.S. PATENT DOCUMENTS

| | | | | |
|---|---|---|---|---|
| 6,362,706 | B1 | 3/2002 | Song et al. | |
| 2006/0044188 | A1* | 3/2006 | Tsai et al. | 343/700 MS |
| 2009/0295504 | A1* | 12/2009 | Andreasson | 333/176 |
| 2010/0045406 | A1* | 2/2010 | Andreasson | 333/202 |
| 2010/0117768 | A1 | 5/2010 | Chuang et al. | |
| 2010/0224324 | A1* | 9/2010 | Kasai | 156/345.36 |

OTHER PUBLICATIONS

Henri Blondeaux, Dominique Baillargeat, Philippe L&veque, Serge Verdeyme, Patrick Vaudon, Pierre Guillon, Annakk Carlier, Yann Cailloce, Microwave Device Combining Filtering and Radiating Functions for Telecommunication Satellites, May 2001, Microwave Symposium Digest, 2001 IEEE MTT-S International, 137-140 vol. 1.*

Guo Qing Luo, Member, IEEE, Zhi Fang Hu, Lin Xi Dong, and Ling Ling Sun, Planar Slot Antenna Backed by Substrate Integrated, Waveguide Cavity, 2008, Antennas and Wireless Propagation Letters, IEEE (vol. 7 ), 236-239.*

Nemai Chandra Karmakar, Investigations Into a Cavity-Backed Circular-Patch Antenna, Dec. 2002 ,IEEE Transa Ctions on Antennas and Propagation, vol. 50, No. 12.*

Dong-Zo Kim, Wang-Ik Son, Won-Gyu Lim, Han-Lim Lee, and Jong-Won Yu, Integrated Planar Monopole Antenna With Microstrip Resonators Having Band-Notched Characteristics, Sep. 2010, IEEE Transactions on Antennas and Propagation, vol. 58, No. 9.*

(Continued)

*Primary Examiner* — Stephen Jones
*Assistant Examiner* — Scott S Outten
(74) *Attorney, Agent, or Firm* — Jetter & Associates, P.A.

(57) ABSTRACT

An integrated cavity filter/antenna system includes a substrate, a cavity filter formed in or on the substrate. A first cavity resonator is in or on the substrate that is enclosed by metal walls. At least a second cavity resonator is formed in or on the substrate that is enclosed by metal walls. An inter-resonator coupling structure couples energy between the first cavity resonator and the second cavity resonator. An antenna is integrated with one of the cavity resonators so that the antenna acts as both a port of the cavity filter and as a radiating element for the filter/antenna system. A connector is coupled to one of the cavity resonators for coupling energy into the filter/antenna system.

19 Claims, 14 Drawing Sheets

(56) References Cited

OTHER PUBLICATIONS

Blondeaux, H. ; E-mail: blondeau@ircom.unilim.fr ; Baillargeat, D. ; Verdeyme, S. ; Guillon, P.; Radiant Microwave Filter for Telecommunications using High Qu Dielectric Resonator, Oct. 2000, . 30th European Microwave Conference, 2000.*

Xiaoping Chen, Wei Hong, Member, IEEE, Tiejun Cui, Senior Member, IEEE, Jixin Chen, and Ke Wu, Substrate Integrated Waveguide (SIW) Linear Phase Filter, Nov. 2005, IEEE Microwave and Wireless Components Letters, vol. 15, No. 11, 787-789.*

Siwiak, Kazimierz, Bahreini, and Yasaman, Radiowave Propagation and Antennas for Personal Communications, May 2012, Wiley, 3rd Edition, 352.*

Luo et al., High Performance Frequency Selective Surface Using Cascading Substrate Integrated Waveguide Cavities, Dec. 2006, IEEE Microwave and Wireless Components Letters vol. 16. pp. 648-650.*

Nadan et al., Optimization and Miniaturization of a Filter/Antenna Multi-Function Module Using a Composite Ceramic-Foam Substrate, Jun. 1999, 1999 IEEE MTT-S Microwave Symposium Digest, pp. 219-222.*

Nadan et al., Integration of an Antenna/Filter Device, Using a Multi-Layer, Multi-Technology Process, 28th European Microwave Conference, 1998, pp. 672-677.*

Chen et al., Substrate Integrated Waveguide Linear Phase Filter, IEEE Microwave and Wireless COmponents Letters, vol. 15, No. 11, Nov. 2005, pp. 787-789.*

Yazid Yusuf and Xun Gong, "Compact Low-Loss Integration of High-Q 3-D Filters with Highly Efficient Antennas", published Feb. 2011.

Yazid Yusuf and Xun Gong, "A New Class of 3-D Filter/Antenna Integration with High Quality Factor and High Efficiency", in IEEE MTT-S Int. Microwave Symposium Dig., May 23-28, 2010 in Anaheim, CA.

* cited by examiner

INTEGRATED CAVITY FILTER/ANTENNA SYSTEM

STATEMENT REGARDING FEDERALLY SPONSORED RESEARCH

This invention was made with Government support under Agency contract Faculty Early Career Award Grant #0846672 awarded by the National Science Foundation (NSF). The Government has certain rights in this invention.

FIELD

Disclosed embodiments relate to integrated 3-D cavity filter/antenna systems.

BACKGROUND

High-quality (Q)-factor filters are widely implemented in communications and radar systems to reject out-of-band noise and interference while minimizing the attenuation of in-band signals. In order to achieve high Q factors, 3-D structures such as waveguide cavities, evanescent-mode cavities, dielectric resonators (DRs), nonplanar combline structures, quasi-planar electromagnetic bandgap (EBG) structures, and substrate integrated waveguides (SIW) can be used rather than low-Q planar transmission line structures. In addition, highly efficient antennas can improve signal-to-noise ratio (SNR) for receivers and reduce power consumption for transmitters. Traditionally, filters and antennas are separate from one another and are connected via standard 50-ohm ports such as coaxial connectors, which usually results in bulky structures, particularly for 3-D filters and antennas.

To avoid the coaxial connections, a vertical three-pole cavity filter can be integrated with a patch antenna inside a low-temperature cofired ceramic (LTCC) substrate. Such a filter and antenna can be designed separately using 50-ohm ports and then connected together through a slot-to-microstrip transition. The total loss of such system includes the addition of the individual losses from the filter, antenna, and the transition between the filter and the antenna. This transition causes significant connection losses and strongly detunes the filter response due to the antenna loading effect.

The integration of a coplanar waveguide (CPW) filter and a patch antenna without using 50-ohm transitions is also known. The filter and antenna can be co-designed as a single unit whereas the antenna works as both a resonator and a port of the filter. As a result, there are no transition losses and detuning effects in this filter/antenna system. Since this approach was based on a planar transmission line structure, equivalent circuit models were fairly easy to derive and use for optimizing the filter/antenna system. However, the achievable Q factors using this approach are very limited (e.g., generally <200).

SUMMARY

Disclosed embodiments include integrated cavity filter/antenna systems that comprise a substrate, a cavity filter formed in or on the substrate comprising a first 3-D cavity resonator and at least a second 3-D cavity resonator, and an inter-resonator coupling structure for coupling energy between the cavity resonators. An antenna is integrated with one of the cavity resonators so that the antenna acts as both a port of the cavity filter and as a radiating element for the cavity filter/antenna system. While conventional filters have ports on both ends, disclosed cavity filter/antenna systems have one port at one end, and the system radiates at the other end. Moreover, instead of going through traditional 50-ohm ports, disclosed integrated cavity filter/antenna systems provide a transition between the filter and antenna similar to the internal coupling between resonators, which represents reduced loss and renders wide bandwidth.

As used herein, an "antenna integrated with one of the cavity resonators" includes arrangements in which there is no well-defined impedance in the transition between the resonator and the antenna so that the antenna acts as a port of the cavity filter. One disclosed arrangement is a zero physical length embodiment where the antenna is integrated into one side of one of the cavity resonators, such as into the topside of a cavity resonator. Another disclosed arrangement comprises a metallic via connection that extends from within the filter to the antenna. This metallic via embodiment like other disclosed embodiments does not have a well-defined impedance. Disclosed filter/antenna systems also include at least one connector that is coupled to one of the cavity resonators for coupling energy into the filter/antenna system.

Disclosed embodiments also include methods of "co-designing" integrated filter/antenna systems including a resonant filter having an antenna integrated with one of the cavity resonators so that the antenna acts as both a port of the cavity filter and as a radiating element for the filter/antenna system. In disclosed methods, the filter and antenna are treated together in the design, as opposed to conventional cavity filter/antenna system designs where the filters and antennas are designed separately. The antenna is considered as a final stage of the filter. Instead of the transition between the filter and antenna going through traditional 50-ohm ports, the transition between the filter and antenna is designed similar to the internal coupling between the resonators, which provides low loss and a wide bandwidth.

BRIEF DESCRIPTION OF THE DRAWINGS

FIG. 1B is a depiction of the topside (antenna side) of the filter/antenna system shown in FIG. 1A, while

DETAILED DESCRIPTION

Figure 1A:
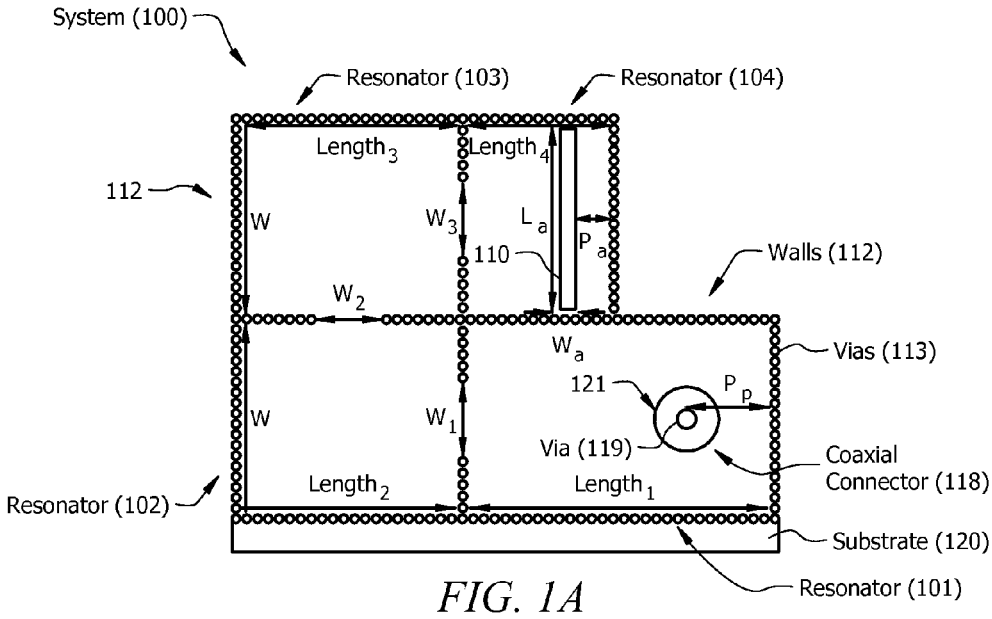
FIG. 1A is a schematic depiction of an example lateral integrated filter/antenna system comprising four cavity resonators that are positioned lateral to one another having a slot antenna integrated into one of the resonators, according to an embodiment of the invention.

Disclosed embodiments in this Disclosure are described with reference to the attached figures, wherein like reference numerals are used throughout the figures to designate similar or equivalent elements. The figures are not drawn to scale and they are provided merely to illustrate the disclosed embodiments. Several aspects are described below with reference to example applications for illustration. It should be understood that numerous specific details, relationships, and methods are set forth to provide a full understanding of the disclosed embodiments. One having ordinary skill in the relevant art, however, will readily recognize that the subject matter disclosed herein can be practiced without one or more of the specific details or with other methods. In other instances, well-known structures or operations are not shown in detail to avoid obscuring structures or operations that are not well-known. This Disclosure is not limited by the illustrated ordering of acts or events, as some acts may occur in different orders and/or concurrently with other acts or events. Furthermore, not all illustrated acts or events are required to implement a methodology in accordance with this Disclosure.

Notwithstanding that the numerical ranges and parameters setting forth the broad scope of this Disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5.

Disclosed integrated cavity filter/antenna systems are enabled by new antenna/filter co-design methodologies that position the antenna so that the antenna is integrated within one of the cavity resonators in the filter/antenna system, and the antenna acts as both a port of the cavity filter and as a radiating element of the filter/antenna system. As described below, the quality of filtering and antenna radiation characteristics are both preserved in disclosed filter/antenna systems. Moreover, it has been found that there is near-zero transition loss between the cavity filter and the antenna.

As used herein, the term "cavity resonator" refers to a space enclosed by metallic conductors on all sides (top, bottom and sides) which in operation is excited in such a way that it becomes a source of electromagnetic oscillations. The resonant frequency of the cavity is determined by the shape of the cavity and the mode, or allowable field distribution, of the electromagnetic energy that the cavity contains.

Although X-band (8.0 GHz to 12.0 GHz) cavity filter/antenna systems are generally described herein, disclosed cavity filter/antenna systems can be extended to microwave, millimeter-wave, and submillimeter-wave frequencies with appropriate fabrication techniques and materials, such as from 100 MHz to about 300 GHz.

Figure 1B:
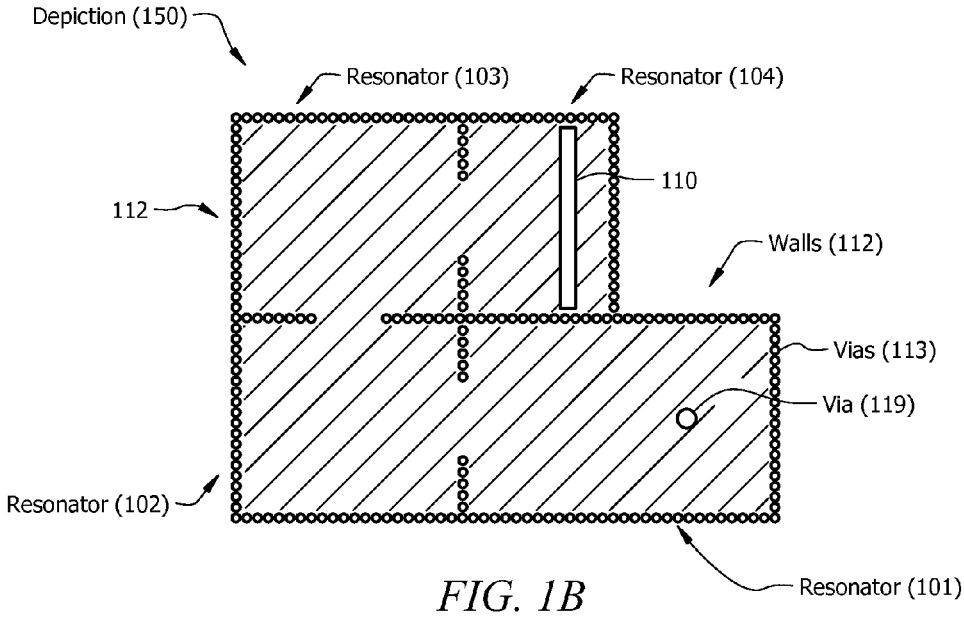
Figure 1C:
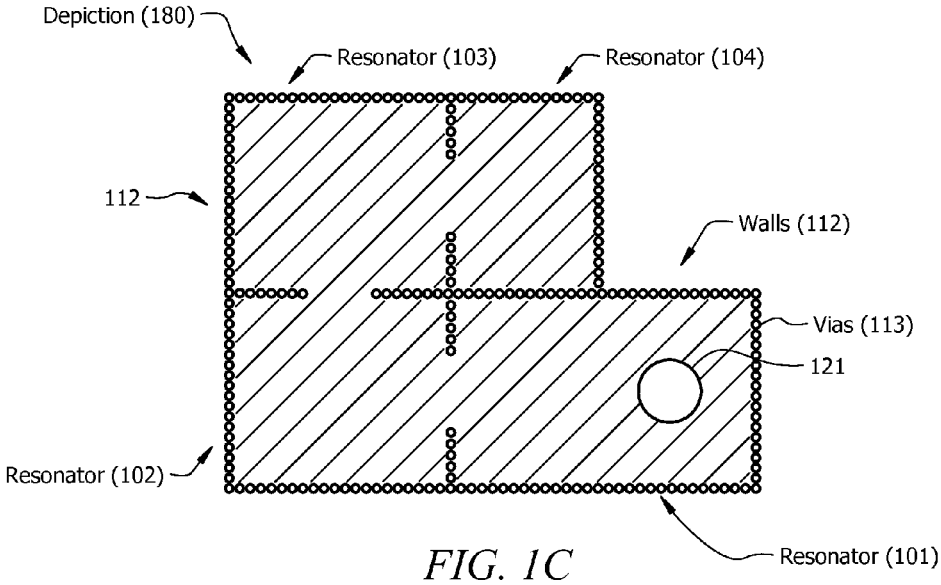
FIG. 1C is a depiction of the bottomside (coaxial feed side) of the filter/antenna system shown in FIG. 1A.

FIG. 1A is a schematic depiction of an example lateral integrated cavity filter/antenna system 100 comprising a cavity filter including four cavity resonators 101-104 (hereafter "cavity filter 101-104") that are positioned lateral to one another which are each enclosed (top, sides and top; only side walls shown) by metal walls having a slot antenna 110 integrated into a top surface of one of the resonators 104, according to an embodiment of the invention. In one particular embodiment filter/antenna system 100 is designed to implement a four-pole Chebyshev bandpass filter operating at X-band. FIG. 1B is a depiction 150 of the metal topside (antenna side) of the filter/antenna system 100, while FIG. 1C is a depiction 180 of the metal bottomside (coaxial RF connector (SMA) 118, hereafter "coaxial connector 118"/feed side) of the filter/antenna system 100.

Being integrated into the cavity filter 101-104, the antenna 110 shown as a slot antenna acts as both a port of the cavity filter 101-104 and as a radiating element of the filter/antenna system 100. Although the antenna 110 is shown as a slot antenna, a variety of other antenna structures can be used with disclosed integrated cavity filter/antenna systems, such as patch and wire antennas, depending on the design preference and application.

Side metal walls 112 for each cavity resonator 101-104 can be formed by closely-spaced metal filled vias 113 referred to herein as metallic vias. The diameter and spacing of the vias 113 in one particular embodiment can be 500 μm and 700 μm, respectively. The gap (spacing) between the vias 113 of 200 μm is much smaller than the wavelength at band of operation, X band for filter/antenna system 100. Since the gaps (spacing) between the vias 113 are much smaller than the wavelength of operation, the energy leakage (loss) through the side walls 112 of the resonators 101-104 is generally insignificant compared with the metallic and dielectric (substrate) losses for filter/antenna system 100.

Inter-resonator coupling structures are provided in the substrate for coupling energy between adjacent cavity resonators. Inter-resonator coupling structures are shown in FIG. 1A embodied as irises (gaps in the metal vias 113) between the resonators, denoted in FIG. 1A as $W_1$, $W_2$, and $W_3$, representing magnetic coupling. $Length_1$, $Length_2$, $Length_3$ and $Length_4$ shown in FIG. 1A represent the respective length dimensions of the resonators 101-104 while W represents their width dimension.

The coaxial connector 118 can be a short-ended coaxial feed for external coupling coupled to resonator 101 for coupling energy into the filter/antenna system 100. Filter/antenna system 100 comprises a substrate 120 upon which the filter/antenna system 100 is built. In one embodiment the substrate 120 is a dielectric substrate. For example, in one particular embodiment the substrate 120 is a 3.17-mm-thick RT/DUROID® 5880 substrate with specified $\in_r$=2.2 and tan δ=0.0009 from provided by Rogers Corp. The substrate 120 may also comprise a semiconductor substrate, such as silicon.

In one particular embodiment the coaxial connector 118 comprises a via 119 of 1.27 mm in diameter that can be drilled for the inner conductor of the coaxial connector 118. On the top side of the filter shown in FIG. 1B a circle 121 of 4.32 mm in diameter can be co-centered with the via 119 and be etched to allow the energy coupling between the coaxial connector 118 and the cavity filter 101-104 by coupling to cavity resonator 101.

The two end resonators 101 and 104, which are located on the right hand side shown in FIG. 1A, can be seen to have a larger size compared to the size of resonators 102 and 103, which represents compensation in the design due to the frequency loading effect from the external coupling. The frequency loading effect from the coaxial connector 118 and slot antenna 110 is different. For the slot antenna case, the resonator size is reduced, while for the coaxial connector 118 case, the resonator size is increased. The distance between the center of the coaxial line of coaxial connector 118 and right end side wall 112 of the resonator 101, denoted as Pp in FIG. 1A, can be adjusted to achieve the critical external coupling. The inner conductor that fills via 119 of the coaxial connector 118 can be soldered on the backside of the filter/antenna system 100 to form the short-ended connection.

Although filter/antenna system 100 is based on a substrate integrated waveguide (SIW) structure that is chosen here due to its ease of fabrication and high-Q performance, disclosed embodiments can include other 3-D structures, such as an air-loaded waveguide cavity, a dielectric resonator, a combline resonator, or an evanescent-mode resonator.

Figure 2:
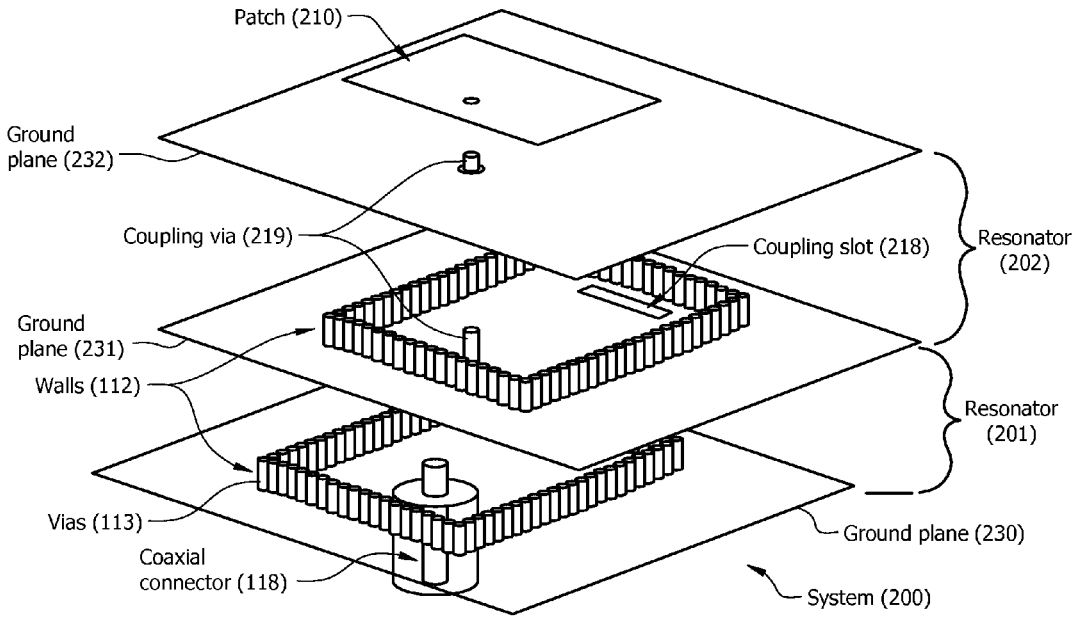
FIG. 2 is an exploded view of a vertical integrated three-pole filter/antenna comprising two cavity resonators and one patch antenna (dielectric material not shown), according to an embodiment of the invention.

FIG. 2 is an exploded view of a vertical integrated three-pole filter/antenna system 200 comprising two vertical cavity resonators 201 and 202 and one patch antenna 210 (dielectric material not shown), according to an embodiment of the invention. The cavity resonators 201 and 202 shown can be realized using the side metal walls 112 comprising closely-spaced metal filled vias 113 described above relative to FIG. 1A, the spacing between which is very small compared with the wavelength of operation to limit leakage. System 200 includes a bottom ground plane 230, a common (center) ground plane 231 and a top ground plane 232.

The internal coupling between the two cavity resonators 201 and 202 is through a coupling slot 218 in the common (center) ground plane 231 between the resonators 201 and 202. The coupling between the resonator 202 and the patch antenna 210 is through a coupling via 219 that protrudes from ground plane 232. The protruding via aspect coupled to a patch antenna is described below relative to FIGS. 4A-E. The external coupling to the cavity resonator 201-202 is achieved by using a coaxial connector 118.

Integrated filter/antenna system 200 exhibits three transmission poles, similar to a three-pole filter, with patch antenna 210 providing one of the transmission poles. The co-design synthesis procedure described below where the antenna is considered as final stage of the filter, which designs the transition between the filter and antenna similar to the internal coupling between resonators, ensures that the integrated filter/antenna system has all the analogues of an equivalent three-pole filter in terms of resonators, internal couplings, and external couplings. As described below in the examples section, the bandwidth of filter/antenna system 200 can be wider as compared to the bandwidth of the patch antenna 210 in isolation.

Disclosed methods and systems are not limited to a substrate-based cavity or even rectangular shape. Disclosed embodiments include numerous 3-D filter structures such as cylindrical cavities, dielectric-resonator-based cavities, combline filters, or evanescent-mode filters, some of which are described below. Disclosed embodiments can also be applied to planar filters, as well as air-filled cavities.

FIGS. 3A-F, FIGS. 4A-E, and FIGS. 5A-E are depictions of example integrated filter/antenna systems comprising 3-D resonant filter structures including cylindrical cavities, dielectric-resonator-based cavities, combline filters, and evanescent-mode filters. In particular, the evanescent-mode and combline filter embodiments perform well for tunable filters with wide tuning range. Filter tuning can be accomplished by changing the capacitance at the top of the metallic post within both types of resonators. This change can be done either mechanically or electrically.

Although not shown, as noted above, the all sides of the resonators are metalized, including the sides, top, and bottom. Side metal walls can comprise the side metal walls 112 described above comprising closely-spaced metal filled vias 113. As described above, the transition between the filter and antenna is nearly lossless due to the integrated nature, and there is no significant physical length (including zero physical length embodiments) between the filter and the antenna.

Figure 3A:
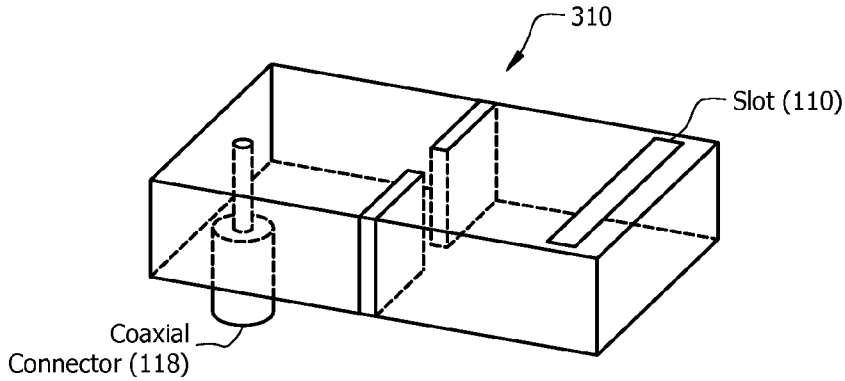
FIG. 3A-F are depictions of example integrated filter/antenna systems having integrated slot antennas, according to an embodiment of the invention.
Figure 3B:
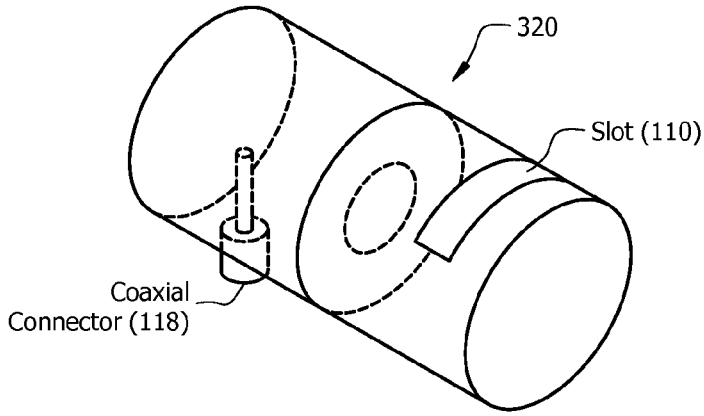
Figure 3C:
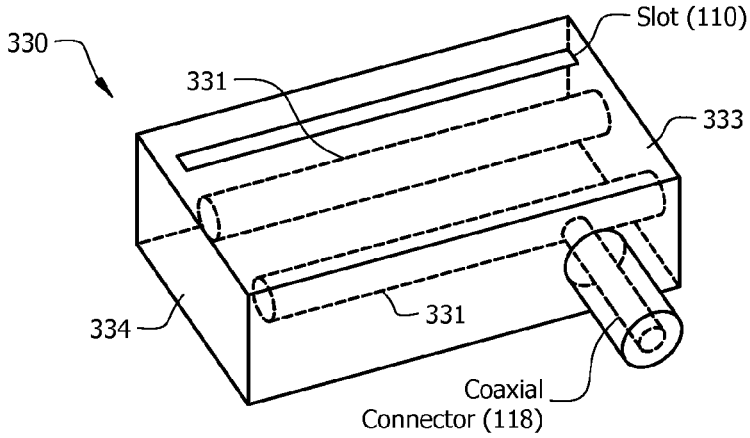

For example, FIGS. 3A-F are depictions of example integrated filter/antenna systems having integrated slot antennas 110, according to embodiments of the invention. Integrated filter/antenna system 310 depicted in FIG. 3A is a rectangular cavity filter/antenna system, similar to integrated filter/antenna system 100 shown in FIG. 1A. Integrated filter/antenna system 320 depicted in FIG. 3B a cylindrical cavity filter. Integrated filter/antenna system 330 depicted in FIG. 3C features a combline filter. A combline filter comprises resonators which each include at least one long metallic post 331 connected to one side of a resonant cavity 333 and in close proximity with the other side of the resonant cavity 334. The shape looks like a "comb". This structure is known for compact size and relatively high Q factor.

Figure 3D:
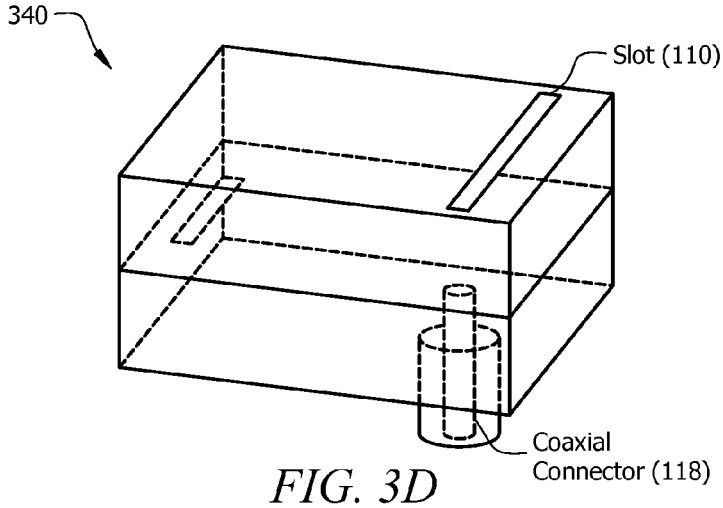
Figure 3E:
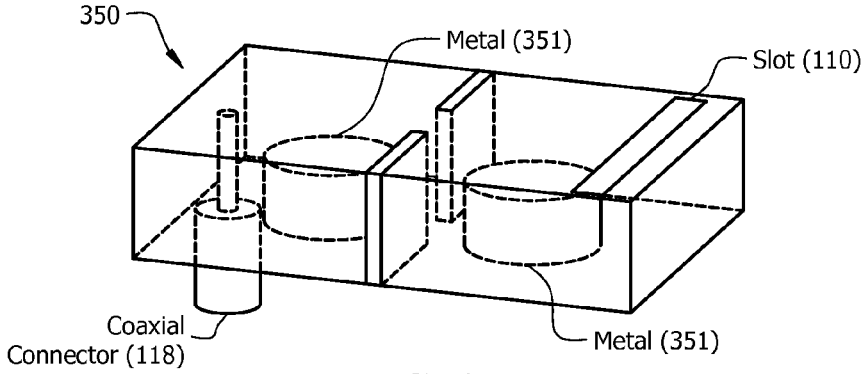

Integrated filter/antenna system 340 depicted in FIG. 3D features a vertical rectangular cavity filter. Integrated filter/antenna system 340 depicted in FIG. 3D is similar to integrated filter/antenna system 200 depicted in FIG. 2. Integrated filter/antenna system 350 depicted in FIG. 3E features an evanescent mode cavity filter. The cylinder 351 in the middle of the evanescent mode cavity comprises metal. This creates an evanescent-mode cavity resonator (filter). This geometry can reduce the size of resonator (filter) while maintaining a good Q factor for the resonator.

Figure 3F:
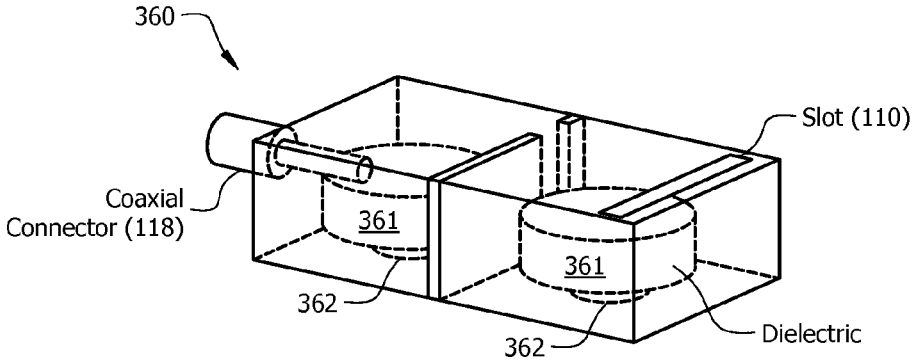
Figure 4A:
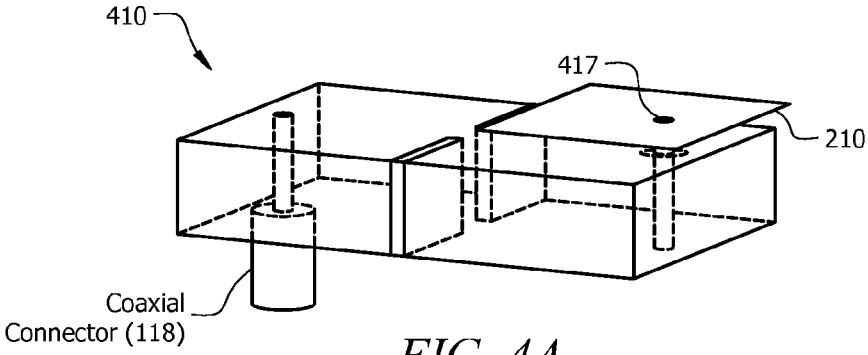
FIG. 4A-E are depictions of example integrated filter/antenna systems having integrated patch antennas, according to an embodiment of the invention.
Figure 4B:
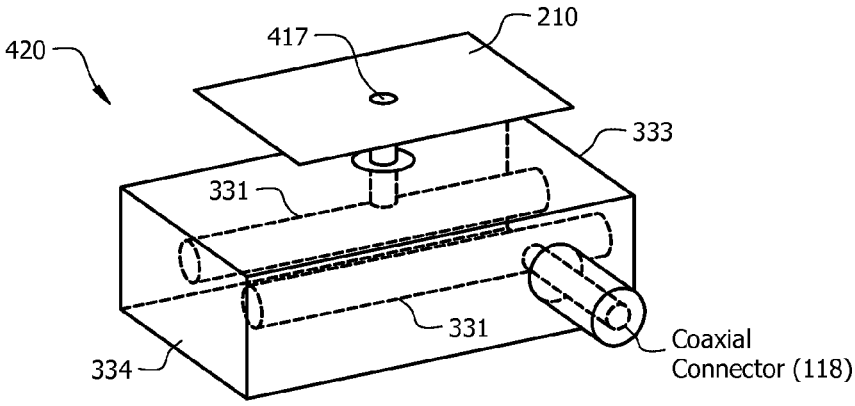
Figure 4C:
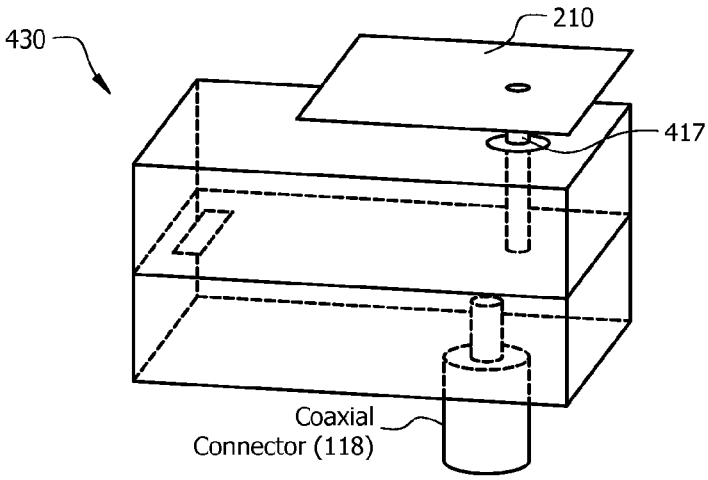
Figure 4D:
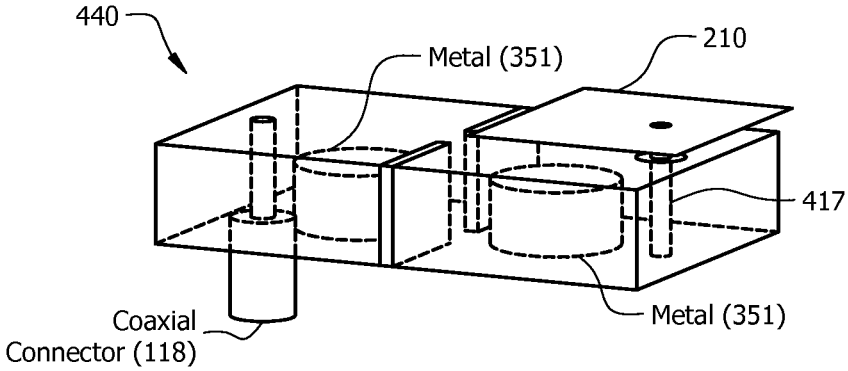
Figure 4E:
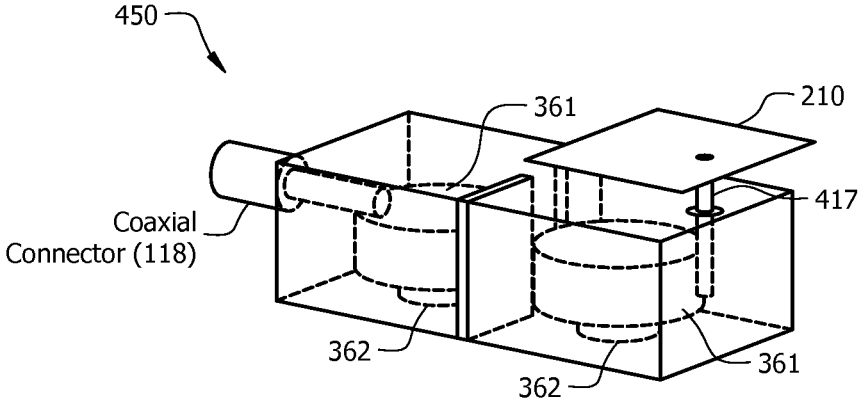
Figure 5A:
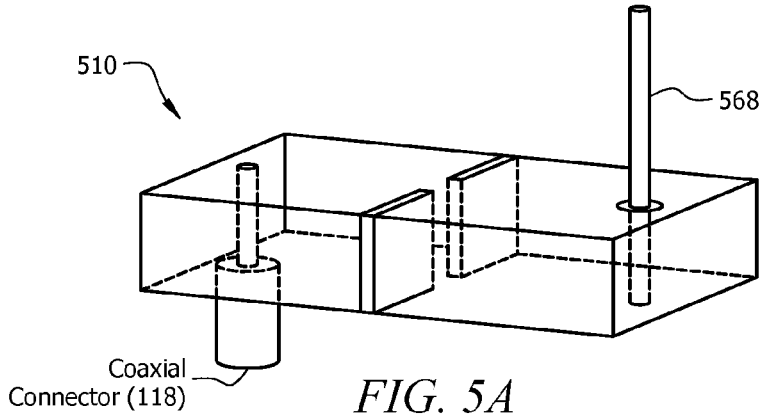
FIG. 5A-E are depictions of example integrated filter/antenna systems having integrated monopole antennas, according to an embodiment of the invention.
Figure 5B:
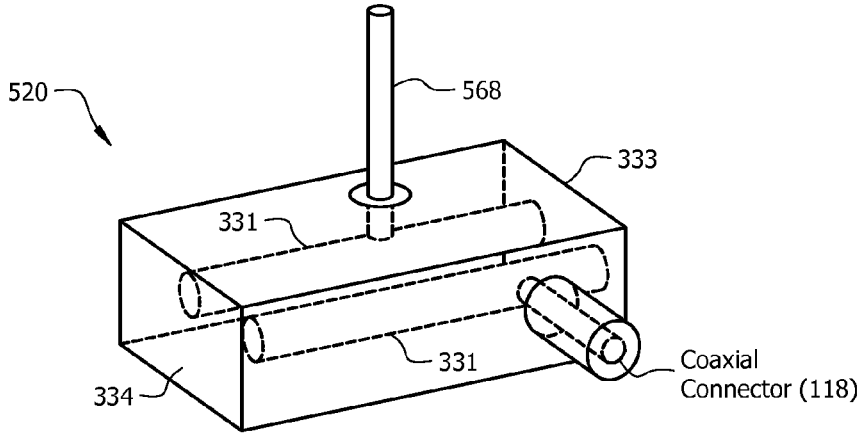
Figure 5C:
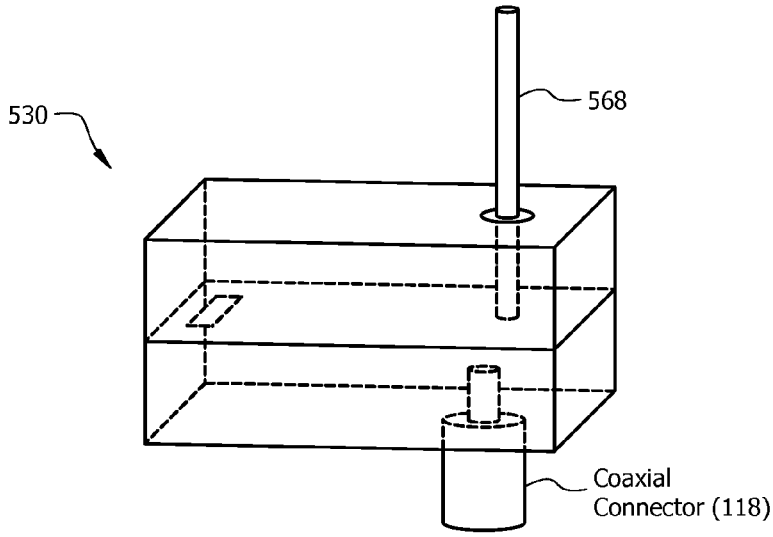
Figure 5D:
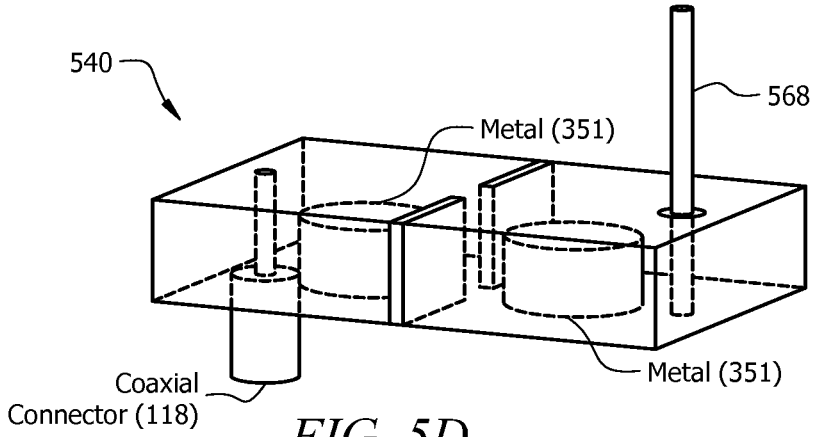
Figure 5E:
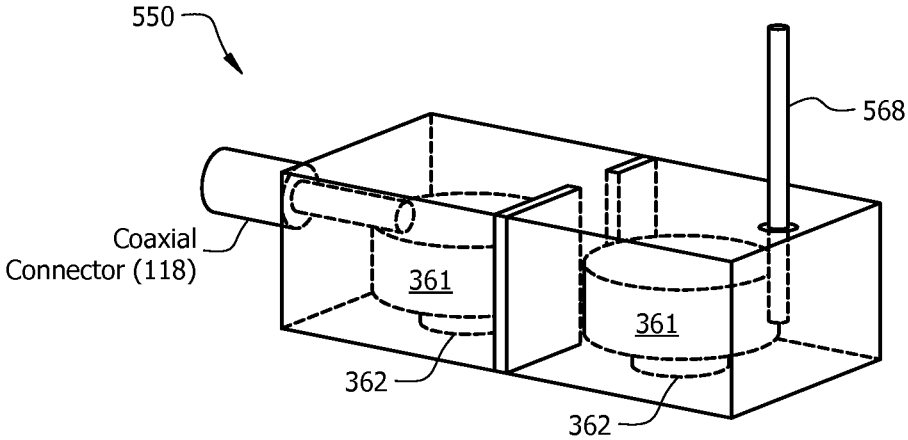

Integrated filter/antenna system 360 depicted in FIG. 3F features a dielectric resonator (DR) filter. The larger cylinders 361 in the middle of the cavities comprises a low-loss high-dielectric-constant ceramic material. The smaller cylinders 362 underneath them provide a support structure comprising a low-dielectric-constant material. DR filters are known for low loss with reduced size.

FIGS. 4A-E are depictions of example integrated filter/antenna systems having integrated patch antennas 210, according to an embodiment of the invention. The patch antennas 210 are a port of the filter since there is a connection between the filter and antenna through a metallic via 417. The integrated filter/antenna system 410 shown in FIG. 4A features a rectangular cavity filter. Integrated filter/antenna system 420 depicted in FIG. 4B features a combline filter. Integrated filter/antenna system 430 depicted in FIG. 4C features a vertical rectangular cavity filter. Integrated filter/antenna system 440 depicted in FIG. 4D features an evanescent mode cavity filter. Integrated filter/antenna system 450 depicted in FIG. 4E features a DR filter.

FIGS. 5A-E are depictions of example integrated filter/antenna systems having integrated monopole antennas 568, according to an embodiment of the invention. Integrated filter/antenna system 520 depicted in FIG. 5B features a combline filter. Integrated filter/antenna system 530 depicted in FIG. 5C features a vertical rectangular cavity filter. Integrated filter/antenna system 540 depicted in FIG. 5D features an evanescent mode cavity filter. Integrated filter/antenna system 550 depicted in FIG. 5E features a DR filter.

Figure 6:
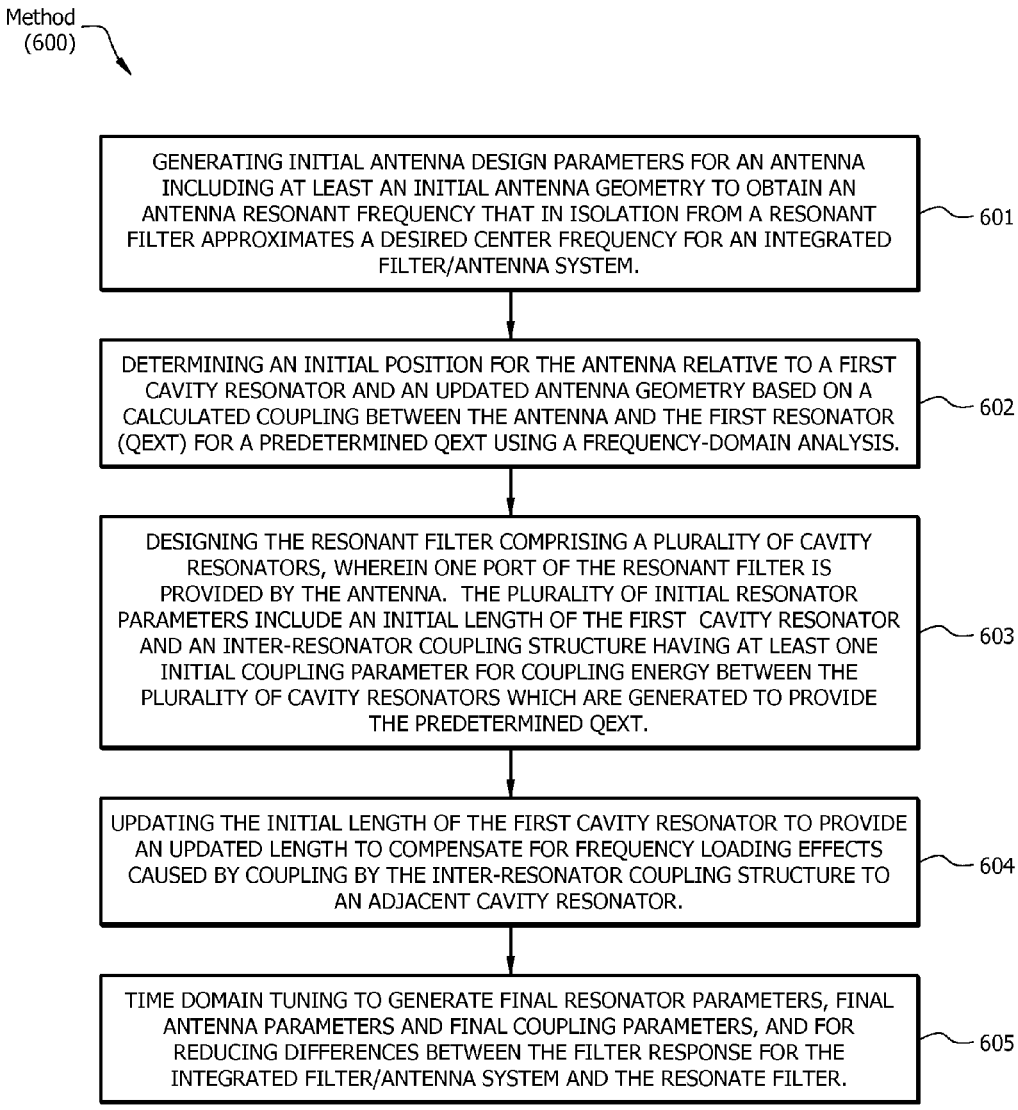
FIG. 6 is a flow chart that shows steps in an example method of co-designing an integrated filter/antenna system including a resonant filter having an antenna integrated with one the cavity resonators so that the antenna acts as both a port of the cavity filter and as a radiating element, according to an embodiment of the invention.

FIG. 6 is a flow chart that shows steps in an example method 600 of co-designing an integrated filter/antenna system including a resonant filter having an antenna integrated with one the cavity resonators so that the antenna acts as both a port of the cavity filter, and as a radiating element, according to an embodiment of the invention. As noted above, in conventional cavity filter/antenna system designs, the filters and antennas are designed separately. In disclosed co-design methods, the filter and antenna are treated together in the design, so that the antenna is considered as a final stage of the filter. Instead of going through traditional 50-ohm ports, the transition between the filter and antenna is designed similar to the internal coupling between the resonators, which provides low loss and wide bandwidth.

Step 601 comprises generating initial antenna design parameters for the antenna including at least an initial antenna geometry to obtain an antenna resonant frequency that in isolation from the resonant filter approximates a desired center frequency for the integrated filter/antenna system. Step 602 comprises determining an initial position for the antenna relative to the first cavity resonator and an updated antenna geometry based on a calculated coupling between the antenna and the first resonator (Qext) for a predetermined Qext using a frequency-domain analysis.

Step 603 comprises designing the resonant filter comprising a plurality of cavity resonators, wherein one port of the resonant filter is provided by the antenna. The plurality of initial resonator parameters include an initial length of the first cavity resonator and an inter-resonator coupling structure having at least one initial coupling parameter for coupling energy between the plurality of cavity resonators which are generated to provide the predetermined Qext.

Step 604 comprises updating the initial length of the first cavity resonator to provide an updated length to compensate for frequency loading effects caused by coupling by the inter-resonator coupling structure to an adjacent cavity resonator. Step 605 comprises time domain tuning to generate final resonator parameters, final antenna parameters and final coupling parameters, and for reducing differences between the filter response for the integrated filter/antenna system and the resonant filter.

Since disclosed filter/antenna systems have small footprints, are highly efficient, and achieve enhanced bandwidth without compromising the high efficiency, they can be advantageously used in a variety of applications. Disclosed cavity filter/antenna systems can be particularly useful for phased arrays by providing high-Q filtering with small form factors and eliminating either bulky coaxial or lossy transmission line connections between filters and their antennas. Therefore, phased arrays with higher sensitivity, less co-site interference, and more robust mechanical structures are made possible by using disclosed cavity filter/antenna systems. Other example applications include low-loss RF front ends, such as for communication systems.

EXAMPLES

Disclosed embodiments are further illustrated by the following specific Examples, which should not be construed as limiting the scope or content of this Disclosure in any way.

Example 1

Based on Filter/Antenna System 100 Shown in FIG. 1A

Example design parameters for a 6.5% fractional bandwidth four-pole Chebyshev filter based on filter/antenna system 100 are shown as:

$$k_{12}=k_{34}=0.046;\ k_{23}=0.037;\ Q_{ext}=20 \quad (1)$$

where $k_{ij}$ is the internal coupling coefficient between the ith and jth resonators and $Q_{ext}$ is the external coupling coefficient of the filter. The final dimensions of the filter comprised $Length_1$=20.4 mm; $Length_2$=14.4 mm; W=13 mm; $W_1$=5.4 mm; $W_2$=4.5 mm; $P_p$=5.6 mm. The filter responses were simulated using Ansoft High Frequency Structure Simulator (HFSS). The simulated center frequency, bandwidth, and insertion loss were found to be 9.85 GHz, 6.5%, and 0.53 dB, respectively. Return losses higher than 17 dB were achieved within the entire passband. Since this filter was used as a reference for the filter/antenna system 100, the S parameters of the filter will be compared with those of the filter/antenna below.

Regarding filter/antenna synthesis, to realize an integrated filter/antenna system 100, one port of the filter is replaced by a slot antenna 110. The slot antenna 110 can be etched on the top side of the end resonator 104. The replacement of one port of the filter by a slot antenna is designed to not change the filtering response of the resonant filter 101-104. In addition, the slot antenna should is designed to have the same radiating characteristics as a standalone slot antenna in terms of both radiation patterns and gain. Therefore, the integrated slot antenna 110 can act as an equivalent port of the resonant filter and a radiating element simultaneously.

To achieve these goals, a slot antenna with a bandwidth wider than the filter bandwidth was selected. The coupling to the slot antenna is the same as that to the port. In other words, the end resonators 101 and 104 of both the filter and filter/antenna system 100 need to have the same $Q_{ext}$. In addition, the frequency loading effect from the slot antenna 110 was taken into account in the design. Since all these factors are properly considered in the design, the filter/antenna system 100 provides essentially the same filtering function as the original cavity filter comprising cavity resonators 101-104.

A mixed frequency-domain/time-domain synthesis technique was developed to achieve near-lossless transition between the filter and antenna and preserve all the desirable functions of the filter and antenna, individually. Full-wave parametric sweeps were used to create design curves or fine tune the filter/antenna structure within finite steps. No optimization in full-wave simulators was needed.

Figure 7:
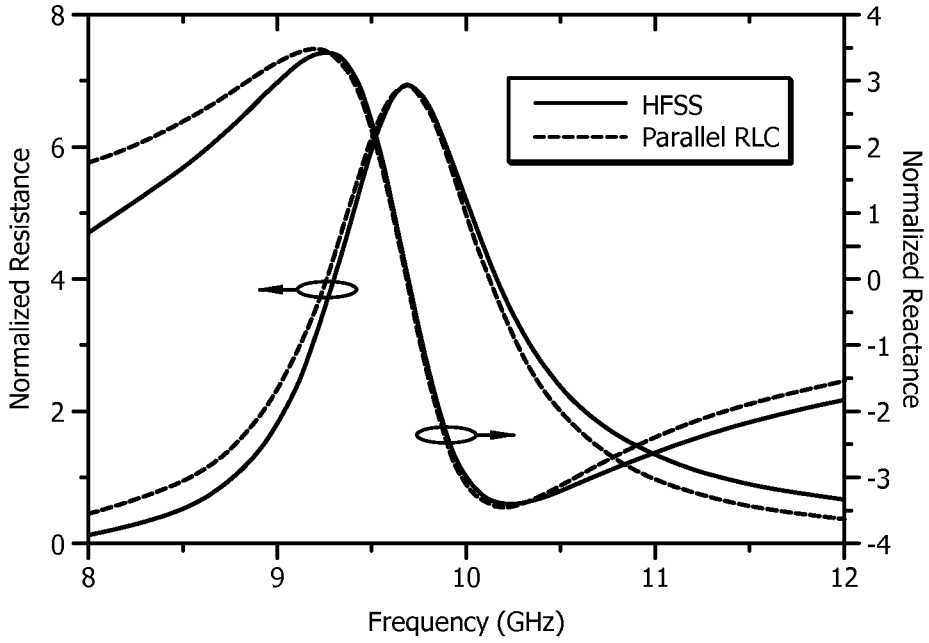
FIG. 7 is a plot of normalized slot antenna impedance for $L_a$=12.1 mm and $W_a$=1 mm, according to an embodiment of the invention.

The design began with selecting an initial length for the slot antenna 100. A transverse slot in the broad wall of a waveguide with a width of W was modeled by an equivalent circuit model including a resistor, capacitor and inductor all in parallel. Using this approach with HFSS simulations, the normalized impedance of the slot was calculated as shown in FIG. 7. In this step, the slot length $L_a$ was chosen to achieve an antenna resonant frequency close to the filter center frequency of 10 GHz. The slot antenna impedance behavior resembles that of a parallel RLC resonator. Therefore, the fractional bandwidth of the slot antenna in this configuration was found be close to 10% (of the center frequency of the filter/antenna system) using:

$$\frac{1}{BW} \approx Q = \frac{f(|Z|_{max})}{\Delta f(|Z|_{max}/\sqrt{2})} \tag{2}$$

The slot antenna 110 inside the end cavity resonator 104 can be modeled by an equivalent circuit. The reflection coefficients of this structure using HFSS simulations and equivalent circuit models were compared and were shown to be very close to each other. It was observed that the phase of $S_{11}$ is 180° at the center frequency of the filter, 9.85 GHz, when $L_4$=10.7 mm. This structure was found to behave like a series RLC resonator around the center frequency of the filter. To verify this behavior, the input impedance of this structure was simulated and compared with that of a series RLC resonator. The element values of the series RLC resonator were extracted using:

$$L = \frac{1}{4\pi}\frac{d(Im(Z_{in}))}{df}\Big|_{f=f_0} \tag{3}$$

$$C = \frac{1}{(2\pi f_0)^2 L} \tag{4}$$

$$R = Z_{in}(f_0) \tag{5}$$

$Q_{ext}$ from the slot antenna can be calculated using:

$$Q_{ext} = \frac{2\pi f_0 L}{R} \tag{6}$$

since the resonator was assumed to be lossless in the simulations. The coupling between the slot antenna and filter, $Q_{ext}$, is controlled by $L_a$ and $P_a$. $Q_{ext}$ can be found using equation (6) by simulation of the equivalent structure. It is noted that the resonator was set to lossless and $L_4$ was adjusted to achieve $S_{11}$ phase of 180° at 9.85 GHz for each combination of $L_a$ and $P_a$. This $L_4$ adjustment can be done by simply de-embedding the waveguide port in simulations.

Figure 8:
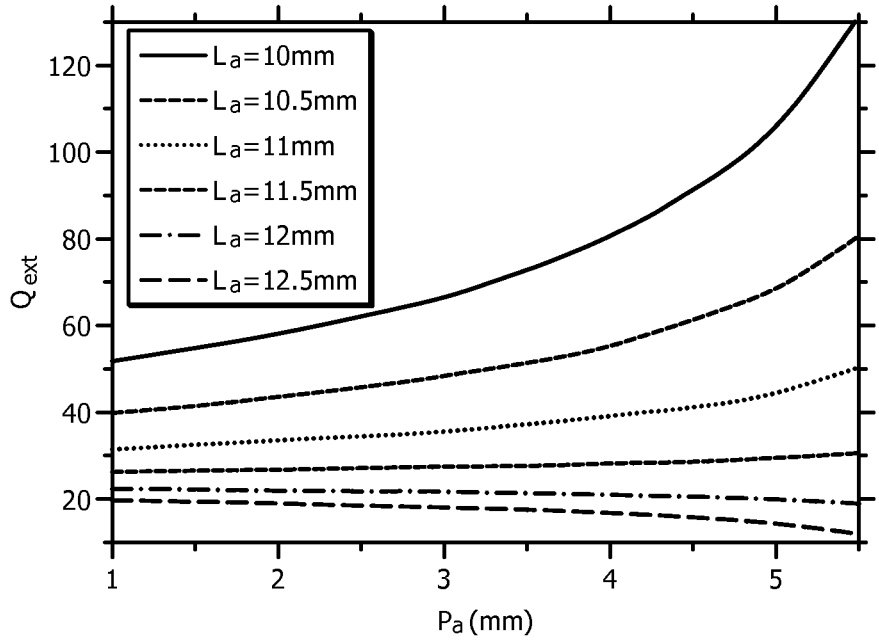
FIG. 8 is extracted $Q_{ext}$ versus slot antenna position $P_a$ data for slot antenna lengths $L_a$=10, 10.5, 11, 11.5, 12, and 12.5 mm, according to an embodiment of the invention.

The design chart for $Q_{ext}$ is shown in FIG. 8. It is noted that there are many different combinations of the two parameters $L_a$ and $P_a$ to achieve the same $Q_{ext}$. This is because the slot antenna has a wider bandwidth than the filter. Therefore a slightly different $L_a$ can still cover the filter bandwidth. From the design chart, $L_a$ and $P_a$ selected to be 12.1 and 2.3 mm, respectively, realized a $Q_{ext}$ of 20. The value of $L_4$ needed to achieve resonance at 9.85 GHz was found to be 10.7 mm. The achievable $Q_{ext}$ range was found to be between 12 and 130, which approximately corresponds to a filter/antenna bandwidth range of 0.8% to 8%.

Figure 9:
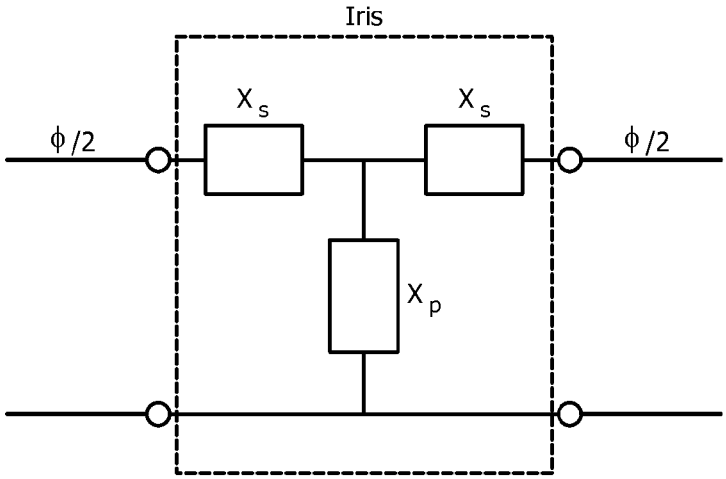
FIG. 9 is the equivalent circuit of an impedance inverter that represents an iris and transmission lines, according to an embodiment of the invention.

Compensation is now made for the end resonator length. When the designed antenna inside a resonator is incorporated in the filter/antenna structure, the length $L_4$ of resonator 104 can be adjusted to account for the frequency loading effect caused by the coupling to the preceding resonator (resonator 103 shown in FIG. 1A). FIG. 9 shows the equivalent circuit of a K inverter that uses an iris as well as two transmission lines of electrical length of Φ/2 on both sides of the iris. The length Φ/2 can be calculated using:

$$\Phi = -\tan^{-1}\left(\frac{2X_p}{Z_0} + \frac{X_s}{Z_0}\right) - \tan^{-1}\left(\frac{X_s}{Z_0}\right) \tag{7}$$

For the particular design described, the length correction was found to be −1 mm and therefore the length $L_4$ was adjusted to 9.7 mm accordingly.

Figure 10:
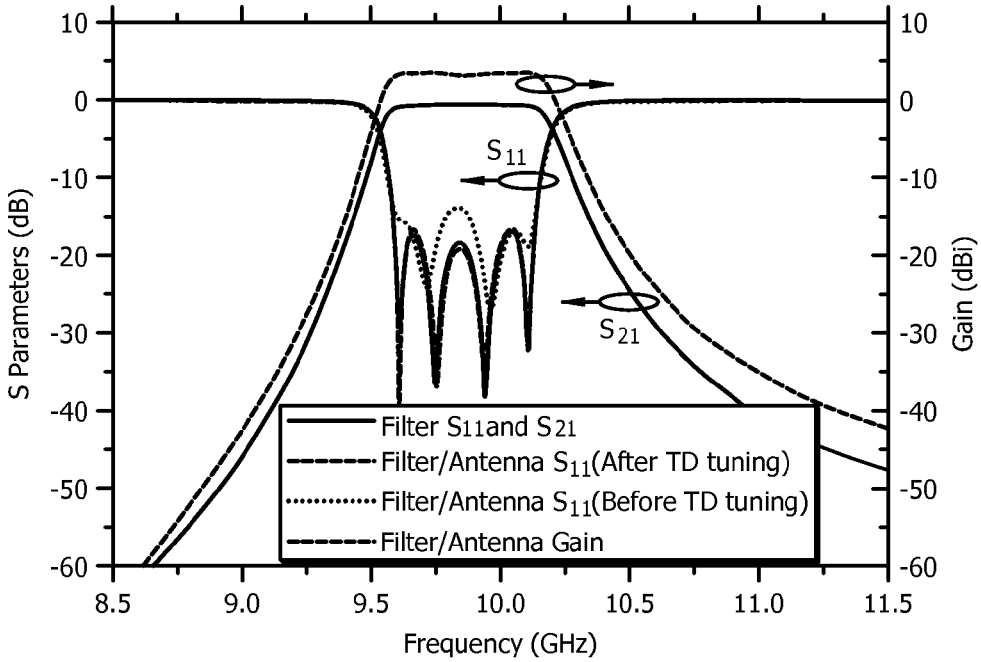
FIG. 10 shows simulated $S_{11}$ and $S_{21}$ of the filter/antenna system shown in FIG. 1A before and after time domain tuning and simulated $S_{11}$ and gain (at the boresight) of the filter/antenna, according to an embodiment of the invention.

Time-Domain (TD) Synthesis of the Filter/Antenna is then performed. Using the filter/antenna structure dimensions from the frequency-domain synthesis, the $S_{11}$ of the filter/antenna is shown in FIG. 10 that can be seen to be noticeably different from the filter $S_{11}$. Optimizing the filter structure in frequency domain is time-consuming and does not represent a synthesis method.

Figure 11:
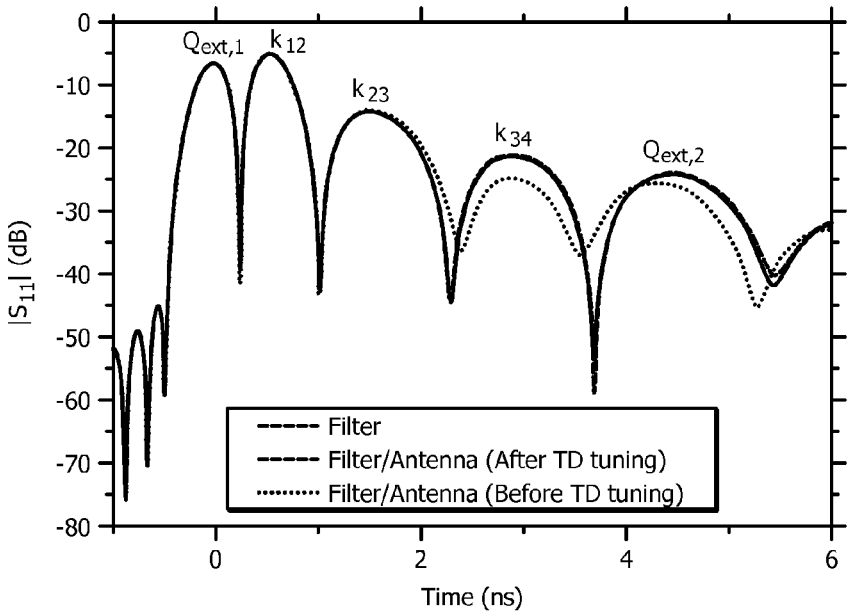
FIG. 11 shows time domain $S_{11}$ responses of the filter, the filter antenna system shown in FIG. 1A both before and after time domain tuning, according to an embodiment of the invention.

To close the synthesis loop, a time-domain filter tuning technique was applied [See application Note 1287-8: simplified filter tuning using time domain, Agilent Technologies Corp., 2001, Palo Alto, Calif.] using a software program developed. This time-domain technique was able to fine-tune the filter response with just a few parametric sweeps. Using an inverse Chirp-Z transform, the filter $S_{11}$ response was plotted in the time domain as shown in FIG. 11. It is observed that the filter responses from different sections of the filter are isolated in the time-domain. The peaks in the time-domain response correspond to the external coupling at Port 1, the internal coupling between resonators 101 and 102 ($k_{12}$), resonators 102 and 103 $k_{23}$, resonators 103 and 104 $k_{34}$, and the external coupling at Port 2, respectively, from left to right.

The dips shown correspond to the resonators 101 through 104, respectively. A rise (sink) of the level of the peaks means smaller (larger) coupling, while the rise of the dips from their minimum values means off-tuned resonances. The filter/antenna $S_{11}$ time-domain response can be tuned to match that of the equivalent filter, one by one from left to right, with a few parametric sweeps. $L_3$ is adjusted to 14.5 mm to match the dip of Resonator 103; $W_3$ is adjusted to 5.2 mm to match $k_{34}$; $L_4$ is fine-tuned to 9.6 mm to the match the dip of Resonator 104; and $L_a$ is fine-tuned to 12.2 to match $Q_{ext}$.

The $S_{11}$ responses of the filter/antenna system 100 in time domain are illustrated in FIG. 11. Before the time-domain fine tuning, discrepancies between the filter and filter/antenna were observed. After the time-domain fine tuning, excellent agreement between the two cases is apparent. As a result, the frequency-domain responses of the two cases were found to match closely as shown in FIG. 10. The gain of the filter/antenna system at the boresight is also shown in FIG. 10. It is found that the filter/antenna system exhibits the same filtering function, which is also observed in other radiation directions.

Example 2

Based on Filter/Antenna System 200 Shown in FIG. 2

Example design parameters for a 8% fractional bandwidth at 10.16 GHz for a three-pole Chebyshev filter based on filter/antenna system 200 are:

$$k_{12}=k_{23}=0.054 \tag{8}$$

$$Q_{ext,1}=Q_{ext,2}=17.2 \tag{9}$$

In this integrated filter/antenna design, the patch antenna replaces 210 the top cavity resonator. The $k_{23}$ now becomes the coupling between the middle cavity and patch antenna 210 which is achieved through a coupling via 219. The radiation Q factor ($Q_{rad}$) of the patch antenna 210 is equivalent to $Q_{ext,2}$ of the reference filter.

The coupling via 219 inside a waveguide was modeled. To build the equivalent circuit for the coupling via 219, a waveguide which is fed by a coaxial connector 118 was converted to an equivalent circuit. The coaxial connector 118 had the same cross-sectional dimensions as the coupling via 219. The inner and outer diameters of the coaxial connector 118 were 0.635 and 1.27 mm, respectively. The equivalent circuit can use an ideal transformer with $1:n_1$ turn ratio and a reactance of $X_1$ from the coaxial connector 118. Using a stationary treatment and selecting the wave impedance $Z_{ow}$ as the characteristic impedance of the waveguide, the turn ratio $n_1$ is given by:

$$n_1^2 = \frac{2h}{W}\left(\frac{\tan(kh)}{kh}\right)^2 \sin^2\left(\frac{\pi c}{W}\right) \tag{10}$$

where h and W are the waveguide height and width, respectively; c is the distance between the center of the coaxial connector 118 and the sidewall of the waveguide; k is the wave number in the dielectrically-loaded waveguide.

The probe-fed patch antenna was then modeled using an equivalent circuit. The reactance $X_2$ represents the inductance of the coaxial connector 118. The position of the coaxial connector 118 d from the edge of the patch antenna 210 determines the turn ratio $n_2$ which can be calculated using:

$$n_2 = \cos\left(\frac{\pi d}{L_p}\right) \tag{11}$$

The position d of the coaxial connector 118 can be used to change the impedance level of the patch antenna 210. The impedance level is a maximum (minimum) when the coaxial connector 118 is at the edge (center). $Q_{rad}$ is primarily controlled by the dielectric constant and the thickness of the substrate. Lower $Q_{rad}$ can be obtained using thicker substrates and lower dielectric constants.

Figure 12A:
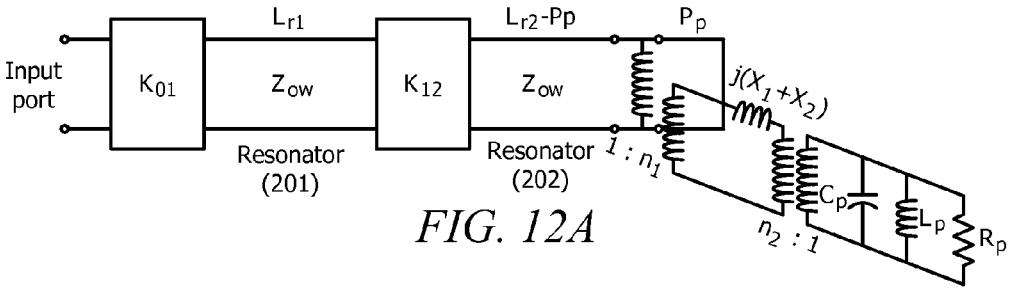
FIG. 12A is an equivalent circuit for an example filter/antenna system, according to an embodiment of the invention.

The filter/antenna system 200 was then modeled. With equivalent circuits described above, the equivalent circuit of the entire filter/antenna system was constructed as shown in FIG. 12A. K inverters shown in FIG. 12A as $K_{01}$ and $K_{12}$ are used to represent the external coupling from the coaxial connector 118 to the bottom resonator 201 and the inter-resonator coupling between the two cavity resonators 201 and 202 shown in FIG. 2. $Lr_1$ refers to the length of the first resonator (Res 1), $Lr_2$ refers to the length of the second resonator (Res 2), while Cp refers to the capacitance of the patch antenna 210, Lp refers to the patch antenna inductance, and Rp refers to the patch antenna resistance. The turn ratio $n_1$ and $n_2$ are controlled by the position of the coaxial connector 118. The collective effects from the two position parameters determine the impedance level of the patch antenna 210 as seen by the cavity resonator 202. The impedance resulting from the shorted-ended waveguide with the length $P_p$ is equal to $jX_p$ which is given by:

$$jx_p = jz_{ow}\tan(\beta P_p) \tag{16}$$

where β is the propagation constant of the waveguide. By reflecting the patch impedance through the two transformers, the simplified equivalent circuit shown in FIG. 12B can be generated. The equivalent circuit element values are:

$$R'_p = \left(\frac{n_2}{n_1}\right)^2 R_p, \quad L'_p = \left(\frac{n_2}{n_1}\right)^2 L_p \tag{17}$$

$$C'_p = \left(\frac{n_1}{n_2}\right)^2 C_p, \quad jX_s = \frac{j(X_1 + X_2)}{n_1^2} \tag{18}$$

Figure 12B:
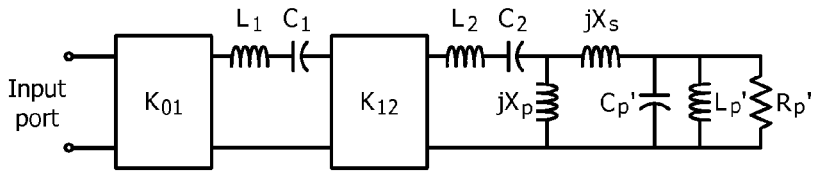
FIG. 12B is a simplified equivalent circuit of the filter/antenna system based on the equivalent circuit shown in FIG. 12A, according to an embodiment of the invention.
Figure 12C:
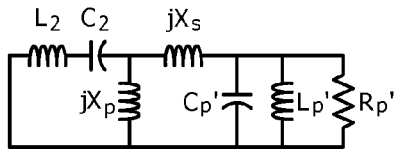
FIG. 12C is an example equivalent circuit of the patch antenna coupled to a cavity resonator, according to an embodiment of the invention.

For the convenience of further analysis, the two cavity resonators 201 and 202 were modeled by series LC circuits in FIG. 12B, with modeled inductance $L_1$, and modeled capacitance $C_1$ used for cavity resonator 201, and modeled inductance $L_2$ and modeled capacitance $C_2$ used for cavity resonator 202. Cp' shown refers to the reflected patch capacitance, Lp' shown refers the reflected patch inductance, and Rp' shown refers to the reflected patch resistance. In order to see the effect of the equivalent circuit parameters and their role in determining the coupling between the middle cavity resonator and patch antenna, the equivalent circuit shown in FIG. 12C was used. Using a coupling of modes formulation [H. A. Haus, Waves and fields in optoelectronics, Prentice-Hall, Englewood Cliffs, 1984, ch. 7.Ref 8], the coupling coefficient $k_{23}$ between the cavity resonator 202 and patch antenna 210 is approximately given by:

$$k_{23} = \frac{1}{2\pi f_o}\frac{X_p}{X_p + X_s}\frac{1}{\sqrt{L_2 C'_p}} \tag{19}$$

Equation (19) shows that this coupling can be controlled by changing $P_p$. The coupling also depends on the reflected patch capacitance $C_p'$, which can be controlled by the selection of $n_1$ and $n_2$ as shown in equation (18). The impedances $jX_s$ and $jX_p$ in the coupling network between the cavity resonator 202 and patch antenna 210 detune their resonant frequencies. However, this frequency detuning effect can be conveniently accounted for with the aid of the equivalent circuit shown in FIG. 12A.

Using the developed equivalent circuits and the described design guidelines, a filter/antenna system was designed and simulated using Ansoft HFSS. The simulated center frequency and bandwidth were 10.16 GHz and 8.0%, respectively. In addition, the filter/antenna responses exactly matched the reference filter responses using circuit simulator. The dimensions of the filter/antenna system 200 were W=12.9; Pc=2.7; Ls=5.7; Ws=0.5; Xs=0.9; Lr1=15.7; Lr2=16; Pp=3.1; c=6.5; d=2.3; Lp=9.1; Wp=14; h1=1.6; h2=0.8, all dimensions being in mm.

Fabrication and measurement results are now presented. A prototype filter/antenna system 200 was fabricated and measured to verify the synthesis procedure described above. Each layer of the entire system was individually fabricated using standard printed circuit board (PCB) fabrication processes. Then the coupling via 219 was soldered into the patch antenna 210 and the cavity resonator 202. The coaxial connector 118 (SMA connector) was soldered to the bottom resonator 201 to form the feeding port. Finally, all three layers were bonded together using a solder paste inside a reflow oven.

Figure 13:
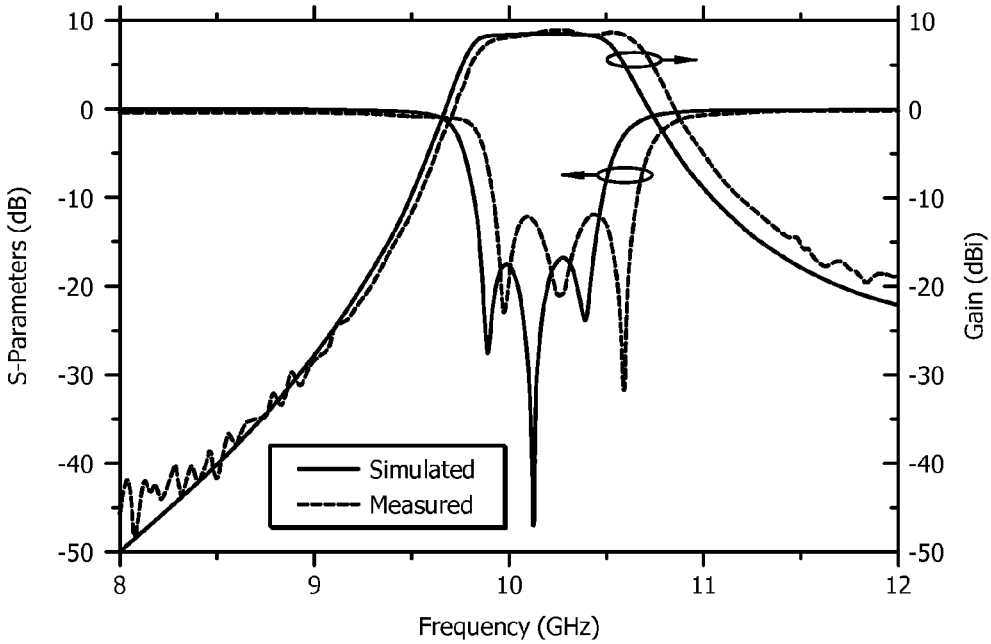
FIG. 13 shows simulated and measured responses of a three-pole vertically integrated filter with a patch antenna, according to an embodiment of the invention.

The measured filter/antenna $S_{11}$ agreed very well with simulation results as shown in FIG. 13. The measured center frequency was 10.27 GHz, compared with 10.16 GHz in the simulation. This 1.1% frequency shift is largely due to the fabrication tolerances. Return losses higher than 12 dB are measured across the filter/antenna passband. It is clearly seen in FIG. 13 that three transmission poles have been achieved with two resonators 201 and 202 and one patch antenna 210. To verify the filtering function of this integrated filter/antenna system 200, the gain of the filter/antenna system 200 was measured in an anechoic chamber. The measured gain versus frequency is plotted against the simulation results as shown in FIG. 13. Both simulation and measurement results demonstrate the third-order filtering function across a wide frequency range. The measured filter/antenna bandwidth of 8.7% was found to be slightly larger than the simulated 8.0%.

The radiation patterns of the filter/antenna were measured in both E and H-planes. The measured patterns were found to match the simulation results at the center frequency. As expected, these radiation patterns are typical for patch antennas. It is noted that the measured radiation patterns are slightly narrower than in simulation particularly in the E-plane, which corresponds to a higher directivity. Similar radiation patterns are observed across the entire passband. Therefore, the integrated patch antenna is able to function within an 8.7% fraction bandwidth, which is much larger than the bandwidth (approximately 1%) of a probe-fed standalone patch antenna with the same dimensions.

The simulated directivity and gain using HFSS were found to be 8.9 and 8.5 dBi, respectively. Therefore, the overall efficiency of the integrated filter/antenna system was calculated using Gain/Directivity and found to be 91%. The gain at the center frequency was measured to be 8.8 dBi, which is slightly higher than the simulated gain. This was attributed to the slightly larger directivity observed in measurements.

While various disclosed embodiments have been described above, it should be understood that they have been presented by way of example only, and not limitation. Numerous changes to the subject matter disclosed herein can be made in accordance with this Disclosure without departing from the spirit or scope of this Disclosure. In addition, while a particular feature may have been disclosed with respect to only one of several implementations, such feature may be combined with one or more other features of the other implementations as may be desired and advantageous for any given or particular application.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which embodiments of the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

We claim:

1. An integrated cavity filter/antenna system, comprising:

a substrate;

a cavity filter formed in or on said substrate, comprising:

a first cavity resonator in or on said substrate, said first cavity resonator comprising a first 3D cavity enclosed by metal walls providing a first transmission pole;

at least a second cavity resonator formed in or on said substrate, said second cavity resonator comprising a second 3D cavity enclosed by metal walls providing a second transmission pole;

an inter-resonator coupling structure in or on said substrate for coupling energy between said first cavity resonator and said second cavity resonator configured so that said first cavity resonator maintains said first transmission pole, and said second cavity resonator maintains said second transmission pole, an antenna integrated with one of said first and second cavity resonators so that said antenna acts as both a port of said cavity filter and as a radiating element, and at least one connector coupled to said first or said second cavity resonator for coupling energy into said filter/antenna system, wherein said metal walls include subwavelength spaced metal via sidewalls for said first resonator and said second cavity resonator, and said inter-resonator coupling structures comprise irises in said metal walls.

2. The filter/antenna system of claim 1, wherein said filter/antenna system comprises a vertical system design where said first cavity resonator and said second cavity resonator are positioned vertical to one another.

3. The filter/antenna system of claim 2, wherein said antenna comprises a patch antenna that is connected by a metallic via that extends from within said cavity filter to said patch antenna, wherein said filter/antenna/filter system has a bandwidth which is wider than a bandwidth of said antenna in isolation, and wherein said patch antenna acts as an additional resonator that provides an additional transmission pole for said filter/antenna system.

4. The filter/antenna system of claim 1, wherein said filter/antenna system comprises a lateral system design where said first cavity resonator and said second cavity resonator are positioned lateral to one another.

5. The filter/antenna system of claim 1, further comprising a metal or dielectric structure within at least one of said first cavity resonator and said second cavity resonator.

6. The filter/antenna system of claim 1, wherein said antenna is integrated into one side of said first resonator or said second resonator.

7. The filter/antenna system of claim 1, wherein said antenna comprises a slot antenna and said cavity filter comprises (a) rectangular cavity filter, (b) cylindrical cavity filter, (c) combline filter, (d) vertical rectangular cavity filter, (e) evanescent mode cavity filter, or a (f) dielectric resonator filter.

8. The filter/antenna system of claim 1, wherein said antenna comprises a patch antenna and said cavity filter comprises (a) rectangular cavity filter, (b) combline filter, (c) vertical rectangular cavity filter, (d) evanescent mode cavity filter, or a (e) dielectric resonator filter.

9. The filter/antenna system of claim 1, wherein said antenna comprises a monopole antenna and said cavity filter comprises a (a) rectangular cavity filter, (b) combline filter, (c) vertical rectangular cavity filter, (d) evanescent mode cavity filter, or (e) dielectric resonator filter.

10. A method for designing an integrated cavity filter/antenna system including a resonant filter having an antenna integrated into a first of a plurality of cavity resonators, comprising:

considering a bandwidth of said antenna in isolation with a bandwidth of said cavity filter/antenna system;

generating initial antenna design parameters for said antenna including at least an initial one of an antenna geometry to obtain an antenna resonant frequency that in isolation from said resonant filter approximates a desired center frequency for said an integrated filter/antenna system;

determining an initial one of a position for said antenna relative to said first cavity resonator and an updated one of said antenna geometry based on a calculated coupling between said antenna and said first resonator (Qext) for a predetermined Qext using a frequency-domain analysis;

designing said resonant filter comprising said plurality of cavity resonators, said resonant filter including a plurality of initial ones of resonator parameters including an initial length of said first cavity resonator and an inter-resonator coupling structure having at least one initial coupling parameter for coupling energy between said plurality of cavity resonators to provide said predetermined Qext, wherein one port of said resonant filter is provided by said antenna;

updating said initial length of said first cavity resonator to provide an updated length to compensate for frequency loading effects caused by coupling by said inter-resonator coupling structure to an adjacent one of said plurality of cavity resonators, and time domain tuning to generate final ones of said plurality of resonator parameters, said antenna parameters and said coupling parameter to reduce differences between a filter response for said integrated filter/antenna system and a filter response for said resonant filter.

11. The method of claim 10, wherein said filter/antenna system comprises a vertical system design where said first cavity resonator and said second cavity resonator are positioned vertical to one another.

12. The method of claim 11, wherein said antenna comprises a patch antenna that is connected by a metallic via that extends from within said cavity filter to said patch antenna, wherein said filter/antenna/filter system has a bandwidth which is wider than a bandwidth of said antenna in isolation, and wherein said patch antenna acts as an additional resonator that provides an additional transmission pole for said filter/antenna system.

13. The method of claim 10, wherein said filter/antenna system comprises a lateral system design where said first cavity resonator and said second cavity resonator are positioned lateral to one another.

14. The method of claim 13, wherein said antenna comprises a slot antenna.

15. The method of claim 10, wherein said antenna is integrated into one side of said first resonator or said second resonator.

16. The method of claim 10, wherein said antenna comprises a slot antenna and said cavity filter comprises (a) rectangular cavity filter, (b) cylindrical cavity filter, (c) combline filter, (d) vertical rectangular cavity filter, (e) evanescent mode cavity filter, or a (f) dielectric resonator filter.

17. The method of claim 10, wherein said antenna comprises a patch antenna and said cavity filter comprises (a) rectangular cavity filter, (b) combline filter, (c) vertical rectangular cavity filter, (d) evanescent mode cavity filter, or a (e) dielectric resonator filter.

18. The method of claim 10, wherein said antenna comprises a monopole antenna and said cavity filter comprises a (a) rectangular cavity filter, (b) combline filter, (c) vertical rectangular cavity filter, (d) evanescent mode cavity filter, or (e) dielectric resonator filter.

19. The method of claim 10, wherein said plurality of cavity resonators include metal walls comprising subwavelength spaced metal via sidewalls, and said inter-resonator coupling structures comprise irises in said metal walls.

* * * * *